US006944268B2

(12) United States Patent
Shimono

(10) Patent No.: US 6,944,268 B2
(45) Date of Patent: Sep. 13, 2005

(54) X-RAY GENERATOR

(75) Inventor: Takashi Shimono, Kuroiso (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 36 days.

(21) Appl. No.: 10/469,769

(22) PCT Filed: Aug. 29, 2002

(86) PCT No.: PCT/JP02/08700

§ 371 (c)(1),
(2), (4) Date: Sep. 4, 2003

(87) PCT Pub. No.: WO03/019995

PCT Pub. Date: Mar. 6, 2003

(65) Prior Publication Data

US 2004/0114722 A1 Jun. 17, 2004

(30) Foreign Application Priority Data

Aug. 29, 2001 (JP) ..... P 2001-259088

(51) Int. Cl.[7] ..... H05G 1/32
(52) U.S. Cl. ..... 378/111; 378/138
(58) Field of Search ..... 378/111–113, 137–139

(56) References Cited

U.S. PATENT DOCUMENTS 3,395,311 A * 7/1968 Hursh ..... 315/379
4,104,526 A * 8/1978 Albert ..... 378/106
4,334,153 A * 6/1982 Stehman et al. ..... 378/113
4,730,353 A 3/1988 Ono et al.
4,760,370 A 7/1988 Nikaido et al.
4,777,642 A 10/1988 Ono
6,816,573 B2 * 11/2004 Hirano et al. ..... 378/114

FOREIGN PATENT DOCUMENTS

| | | |
|---|---|---|
| DE | 31 36 881 A1 | 5/1982 |
| EP | 0 251 137 | 1/1988 |
| FR | 2 491 282 | 4/1982 |
| JP | 57-88699 | 6/1982 |
| JP | 63-6730 | 1/1988 |
| JP | 2-276142 | 11/1990 |
| JP | 7-29532 | 1/1995 |
| JP | 2001-273860 | 10/2001 |

* cited by examiner

*Primary Examiner*—Edward J. Glick
*Assistant Examiner*—Hoon Song
(74) *Attorney, Agent, or Firm*—Pillsbury Winthrop Shaw Pittman LLP

(57) ABSTRACT

An X-ray generator comprises a cathode electrode (15), a grid electrode (17) for controlling an electron beam (e) generated by the cathode electrode (15), a focus electrode (18) for focusing the electron beam (e), and an anode target (14) for emitting X rays by the collision of the electron beam (e). A bias voltage (Vb) is impressed between the cathode electrode (15) and the grid electrode (17) from a bias voltage generating section (20). A tube voltage (Vt) is impressed on the anode target (13) from a tube voltage generating section (19). A voltage dividing section (31) divides the tube voltage (Vt) to generate a focus voltage (Vf). The effect of a variation in voltage on the formation of a focal point of the electron beam is suppressed by impressing such a focus voltage (Vf) on the focus electrode (18).

8 Claims, 7 Drawing Sheets

X-RAY GENERATOR

CROSS REFERENCE TO RELATED APPLICATION

This application is a national phase application of International Application. No. PCT/JP02/08700, filed on Aug. 29, 2002, which claims priority to Japanese Patent Application No. 2001-259088, filed on Aug. 29, 2001.

TECHNICAL FIELD

The present invention relates to an X-ray generator provided with an X-ray tube and the like.

BACKGROUND ART

An X-ray generator is a device incorporating the X-ray tube for emitting X rays in it and often used for medical or industrial diagnostic devices, etc. The X-ray tubes are also practically used in various types according to the uses of the X-ray generators. For example, when an object to be inspected is inspected for its microstructure with X rays, the X-ray tube, the so-called micro focus X-ray tube, having a focal size of the electron beam of approximately several $\mu$m to dozens $\mu$m on an anode target which is a generating field of the X rays is used (e.g., Japanese Patent Laid-Open Application No. 2001-273860).

For example, the above-described micro focus X-ray tube has a structure in which an anode target for emitting X rays and a cathode are respectively disposed within a vacuum vessel. The cathode is comprised of a cathode electrode for generating an electron beam by heating by a heater, a grid electrode for controlling a tube current and a focus electrode for controlling a focal size of the electron beam on the anode target.

Generally, the X-ray tube having the above-described structure determines, for example, a cathode electrode, an anode target or a grid electrode to a ground potential and impresses a prescribed tube voltage on the anode target. An operational state of the X-ray tube is adjusted by, for example, controlling a voltage to be impressed on the focus electrode and the grid electrode. To control the voltage to be impressed on the focus electrode, a power supply for the focus electrode for generating a focus voltage to be impressed on the focus electrode is used independent of the power supply for the anode target for generating the tube voltage.

According to the focus voltage controlling method, however, when the tube voltage to be impressed on the anode target or the focus voltage to be impressed on the focus electrode has a change such as pulsation, a focal shape of the electron beam is affected, and it becomes difficult to form a micro focal point. Specifically, where the focal shape of the electron beam is minimized, it is significant to maintain the proportional relationship between the tube voltage and the focus voltage as indicated by, for example, code P in FIG. 7. If the tube voltage or the focus voltage changes, the proportional relationship shown in FIG. 7 is not maintained, and it becomes difficult to form the micro focal point. It was confirmed through the experiments made by the present inventors that a change in ratio between the tube voltage and the focus voltage by 0.15% has a large influence on the focal diameter.

On the other hand, for example, Japanese Patent Laid-Open Application No. Hei 7-29532 describes an X-ray generator which sets the focus electrode to a ground potential and changes the voltage to be impressed on the cathode electrode at a prescribed ratio in response to a change in voltage to be impressed on the anode target. According to the above existing X-ray generator, the focus electrode keeps the ground potential and does not change it, so that the micro focal point can be maintained stably even if the voltage impressed on the anode target suffers from pulsation.

However, the X-ray generator described in the above publication must have the focus electrode set to a ground potential, so that its device structure is highly limited. For example, the existing X-ray generator generally has the anode target or the grid electrode set to the ground potential, but the micro focal point forming method described in the above publication cannot be applied to the above X-ray generator. Therefore, to set the anode target or the grid electrode to the ground potential, there are demands for a technology which can suppress an effect of a variation in voltage on the formation of the micro focal point of the electron beam.

In the micro focus X-ray tube, the bias voltage is impressed between the cathode electrode and the grid electrode to control a current (tube current) of the electron beam for generating X rays by this bias voltage. Where this tube current control method is applied, it is common to separately dispose a power supply for generating the bias voltage.

However, the above tube current control method allows an excessively large tube current to pass through the X-ray tube if the power supply for the bias voltage fails. Such an excessively large tube current causes melting of the anode target, resulting in degradation of the properties of the X-ray tube and also its destruction and the like. Therefore, it is desired to improve the reliability and safety when the tube current is controlled by the bias voltage impressed on the cathode electrode.

It is an object of the present invention to provide an X-ray generator which can suppress an effect of a variation in voltage upon the formation of a focal point of the electron beam when the anode target or the grid electrode is set to a ground potential. Another object of the invention is to provide an X-ray generator having its reliability and safety improved by preventing the passage of an excessively large tube current when the tube current is controlled by the bias voltage to be impressed on the cathode electrode.

DISCLOSURE OF THE INVENTION

A first X-ray generator of the present invention comprises a cathode electrode generating an electron beam; a grid electrode controlling the passage of the electron beam generated by the cathode electrode; a focus electrode focusing the electron beam; an anode target emitting X rays by collision of the electron beam focused by the focus electrode; a bias voltage generating section generating a bias voltage to be impressed between the cathode electrode and the grid electrode; a tube voltage generating section generating a tube voltage to be impressed on the anode target; and a voltage dividing section dividing the tube voltage to generate a focus voltage and impressing the focus voltage on the focus electrode, and dividing the focus voltage to generate a cathode voltage, wherein the cathode voltage generated by the voltage dividing section and the bias voltage generated by the bias voltage generating section are combined, and the combined voltage is impressed on the cathode electrode.

The X-ray generator of the present invention divides the tube voltage to generate the focus voltage, so that the proportional relationship between the tube voltage and the focus voltage can be maintained even if the tube voltage had a variation such as pulsation. Therefore, an effect by the variation in tube voltage on the focal size of the electron beam is suppressed, and, as a result, the micro focal point of the electron beam can be reproduced accurately.

Beside the first X-ray generator of the invention divides the focus voltage by the voltage dividing section to generate the cathode voltage and combines the cathode voltage with the bias voltage generated by the bias voltage generating section. In such a case, the cathode voltage to be generated by the voltage dividing section is set to a magnitude not to flow the tube current when a voltage having the same magnitude as the cathode voltage is impressed between the cathode electrode and the grid electrode. Thus, it becomes possible to improve the safety of the X-ray generator.

A second X-ray generator of the present invention comprises a cathode electrode generating an electron beam; a grid electrode controlling the passage of the electron beam generated by the cathode electrode; a focus electrode focusing the electron beam; an anode target emitting X rays by the collision of the electron beam focused by the focus electrode; a tube voltage generating section generating a tube voltage to be impressed on the anode target; a focus voltage generating section generating a focus voltage to be impressed on the focus electrode; a bias voltage generating section generating a bias voltage to be impressed between the cathode electrode and the grid electrode; and a voltage dividing section dividing the focus voltage to generate a cathode voltage and combining the cathode voltage with the bias voltage to impress on the cathode electrode.

BEST MODE FOR CARRYING OUT THE INVENTION

Embodiments for practicing the present invention will be described.

Figure 1:
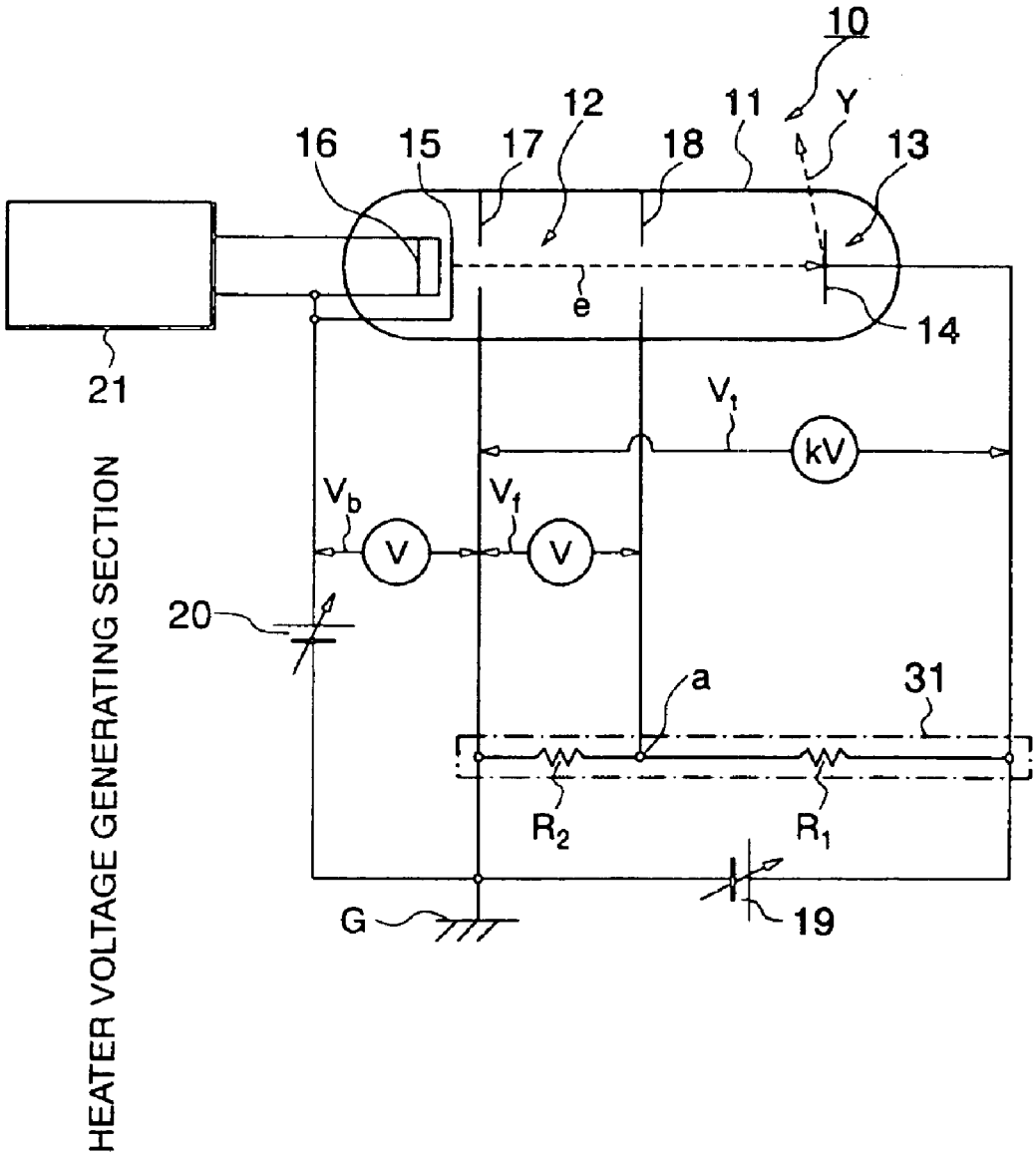
FIG. 1 is a diagram showing a schematic structure and circuitry of the X-ray generator according to a first embodiment of the invention.

FIG. 1 is a diagram showing a structure of the X-ray generator according to a first embodiment of the invention. The X-ray generator shown in the drawing has a micro focus X-ray tube 10. The micro focus X-ray tube 10 is entirely formed of a vacuum vessel 11 in which a cathode 12 is disposed on one side and an anode 13 on the other side. The anode 13 has an anode target 14.

For example, the cathode 12 is comprised of a cathode electrode 15 for generating an electron beam e, a heater 16 for heating the cathode electrode 15, a grid electrode 17 for controlling a flow of the electron beam e (e.g., tube current), and a focus electrode 18 for controlling a focal shape of the electron beam formed on the anode target 14 by focusing the electron beam e.

The X-ray generator of this embodiment has the grid electrode 17 set to a ground potential G. An output-variable tube voltage generating section 19 is connected between the anode target 14 and the ground potential G, and a tube voltage Vt which is positive to the grid electrode 17 is impressed on the anode target 14. The tube voltage Vt is, controlled to a prescribed value.

And an output-variable bias voltage generating section 20 is connected between the cathode electrode 15 and the ground potential G, and a bias voltage Vb which is positive to the grid electrode 17 is impressed on the cathode electrode 15. The tube current of the X-ray tube 10 is controlled by the bias voltage Vb between the cathode electrode 15 and the grid electrode 17. The heater 16A is supplied with prescribed DC or AC power from a heater voltage generating section 21.

A voltage dividing section 31 is connected in parallel to either end of the tube voltage generating section 19. The voltage dividing section 31 is comprised of two resistors $R_1$, $R_2$. These two resistors $R_1$, $R_2$ are connected in series and, for example, determined to be a first resistor $R_1$ and a second resistor $R_2$ in decreasing order of potential of the tube voltage generating section 19. A node a between the first resistor $R_1$ and the second resistor $R_2$ is connected to the focus electrode 18, and the voltage of either end of the second resistor $R_2$ forms a focus voltage Vf.

Specifically, the voltage dividing section 31 divides the tube voltage Vt according to the first resistor $R_1$ and the second resistor $R_2$ to generate the focus voltage Vf at either end of the second resistor $R_2$. And, the focus voltage Vf which is generated by dividing the tube voltage Vt by the voltage dividing section 31 is impressed between the focus electrode 18 and the ground potential G. The focus voltage Vf which is positive to the grid electrode 17 is impressed on the focus electrode 18.

In the X-ray generator configured as described above, the electron beam e generated by the cathode electrode 15 has the tube current controlled by the grid electrode 17 and is further focused by the focus electrode 18 so as to collide with the anode target 14. The collision of the electron beam e with the anode target 14 causes to emit X rays from the anode target 14 in, for example, a direction of arrow Y. At this time, a relationship of the focus voltage Vf impressed on the focus electrode 18 with the tube voltage Vt is expressed as follows.

$$Vf=Vt\times R_2/(R_1+R_2) \quad (1)$$

Figure 7:
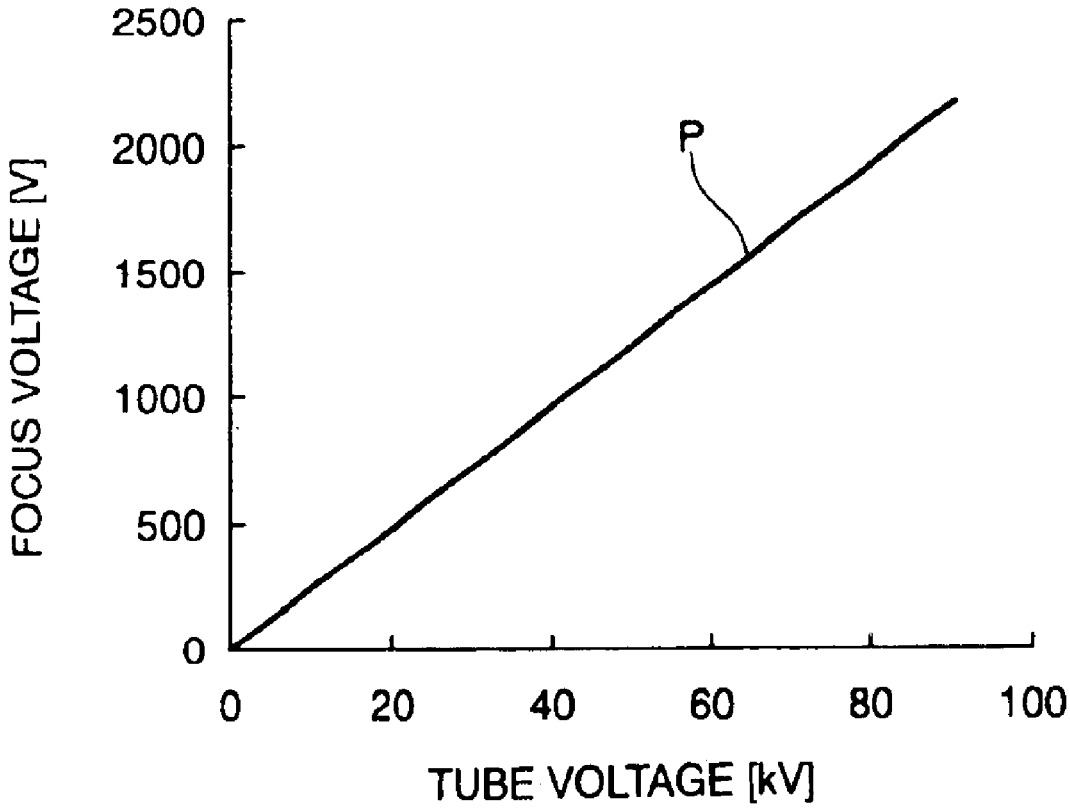
FIG. 7 is a characteristic diagram showing a relationship between a tube voltage and a focus voltage of the X-ray generator.

It is apparent from the expression (1) that the focus voltage Vf and the tube voltage Vt have a proportional relationship as shown in FIG. 7. The proportional relationship between the focus voltage Vf and the tube voltage Vt is basically maintained even if the tube voltage Vt has a change such as pulsation. Therefore, an effect of the change in tube voltage Vt on a focal diameter of the electron beam can be reduced. As a result, it is possible to accurately reproduce a micro focal point of the electron beam on the anode target 14.

Thus, according to the X-ray generator of the first embodiment, an effect of a variation in voltage on the formation of a focal point of the electron beam can be reduced. Therefore, the micro focal point of the electron beam can be reproduced accurately on the anode target 14. Besides, the focus voltage Vf is generated by dividing the tube voltage Vt by the voltage dividing section 31, so that it is not necessary to dispose a focus voltage generating section independent of the tube voltage generating section 19 like the conventional X-ray generator, and an equipment configuration of the X-ray generator can be made simple. According to this embodiment, the grid electrode 17 is set to the ground potential G, but, for example, when the anode target 14 is set to the ground potential, the same operation can be made.

Figure 2:
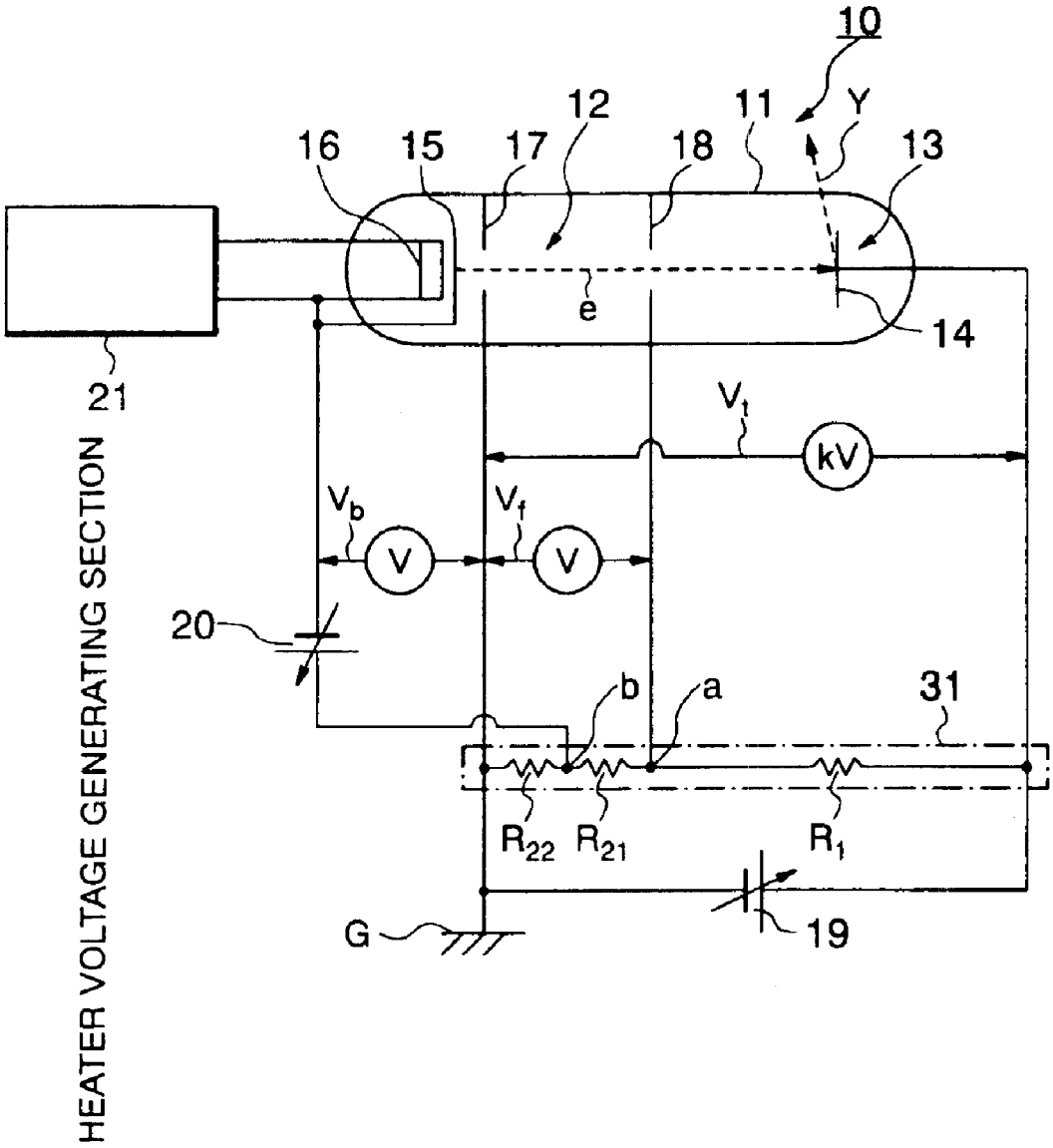
FIG. 2 is a diagram showing a schematic structure and circuitry of the X-ray generator according to a second embodiment of the invention.

Then, the X-ray generator according to a second embodiment of the invention will be described with reference to FIG. 2. FIG. 2 is a diagram showing a structure of the X-ray generator according to the second embodiment of the invention. Like reference numerals are used to denote components of FIG. 2 similar to those of FIG. 1, and the repetition of description is partly omitted.

The X-ray generator shown in FIG. 2 has the voltage dividing section 31 connected in parallel to either end of the tube voltage generating section 19 in the same manner as in the first embodiment. This voltage dividing section 31 is comprised of three resistors $R_1$, $R_{21}$, $R_{22}$. These three resistors $R_1$, $R_{21}$, $R_{22}$ are connected in series. For example, the first resistor $R_1$, the second resistor $R_{21}$ and the third resistor $R_{22}$ are disposed in decreasing order of potential of the tube voltage generating section 19.

And, the node a between the first resistor $R_1$ and the second resistor $R_{21}$ is connected to the focus electrode 18 in the same way as in the first embodiment, and the voltage of either end of the two resistors $R_{21}$, $R_{22}$ is impressed as the focus voltage Vf between the focus electrode 18 and the ground potential G. The focus voltage Vf is a voltage positive to the grid electrode 17.

In the X-ray generator of the second embodiment, the operation of the voltage dividing section 31 for generation of the focus voltage Vf is the same as in the first embodiment, and the focus voltage Vf is in a proportional relationship with the tube voltage Vt. Specifically, the focus voltage Vf has a relationship with the tube voltage Vt as follows.

$$Vf=Vt\times(R_{21}+R_{22})/(R_1+R_{21}+R_{22}) \quad (2)$$

Thus, the focus voltage Vf and the tube voltage Vt have the proportional relationship as shown in FIG. 7, so that an effect of a change in the tube voltage Vt on a focal diameter of the electron beam can be reduced.

According to the X-ray generator of the second embodiment, a node b between the second resistor $R_{21}$ and the third resistor $R_{22}$ of the voltage dividing section 31 is connected to the cathode electrode 15 via the bias voltage generating section 20. Specifically, the voltage dividing section 31 divides the focus voltage Vf according to the second resistor $R_{21}$ and the third resistor $R_{22}$ to generate a cathode voltage Vc (not shown) at either end of the third resistor $R_{22}$ so that the cathode electrode 15 has a voltage positive to the grid electrode 17. The cathode voltage Vc which is generated at either end of the third resistor $R_{22}$ is combined with the output voltage of the bias voltage generating section 20.

Here, the bias voltage generating section 20 of FIG. 2 is connected so that the cathode electrode 15 has a voltage negative to the grid electrode 17 and impresses a negative output voltage Vb' (not shown) on the cathode electrode 15. And, the node b between the second resistor $R_{21}$ and the third resistor $R_{22}$ is connected to the positive terminal of the bias voltage generating section 20, so that a difference between the voltage (cathode voltage) Vc at either end of the third resistor $R_{22}$ and the output voltage Vb' of the bias voltage generating section 20 is supplied to the cathode electrode 15.

Figure 3:
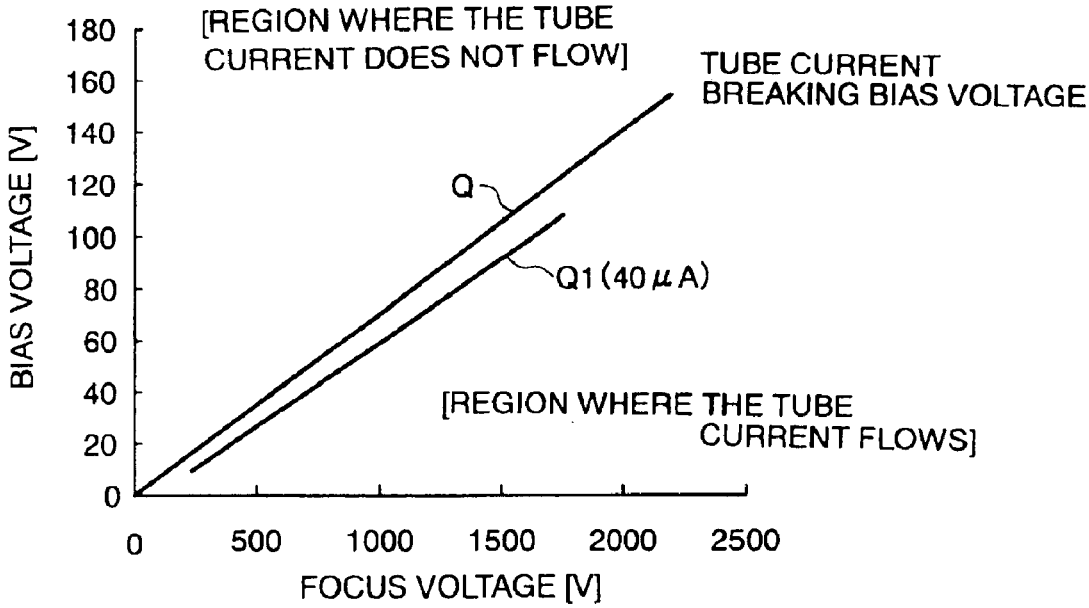
FIG. 3 is a characteristic diagram showing a relationship between a tube voltage and a focus voltage of the X-ray generator according to the embodiment of the invention.

In the micro focus X-ray tube, a tube current is controlled by the bias voltage Vb between the cathode electrode 15 and the grid electrode 17 as described above. Besides, a relationship between the bias voltage Vb and the focus voltage Vf is as indicated by code Q in FIG. 3. In FIG. 3, the horizontal axis indicates a focus voltage [V], the vertical axis indicates a bias voltage [V], and the straight line Q indicates a tube current breaking bias voltage.

As shown in FIG. 3, the tube current does not flow in the region above the tube current breaking bias voltage Q, and the tube current flows in the region below it. In other words, the tube current does not flow when the bias voltage Vb is not smaller than the tube current breaking bias voltage Q with respect to a certain focus voltage Vf. Code Q1 indicates that the tube current is 40 $\mu$A.

It is apparent from the relationship shown in FIG. 7 that, when the tube voltage Vt has an operation range of, for example, 0 to 80 kV, the focus voltage Vf comes to have an adjustment range of 0 to 2000V. In this case, the adjustment range of the bias voltage Vb allowing to flow the tube current becomes, for example, 0 to 150V in view of the relationship shown in FIG. 3. In the first embodiment shown in FIG. 1, the bias voltage Vb in such a range (e.g., 0 to 150V) is directly adjusted by the output voltage of the bias voltage generating section 20 which is connected so that the cathode electrode 15 has a voltage positive to the grid electrode 17.

Meanwhile, in the voltage dividing section 31 of the second embodiment shown in FIG. 2, the voltage (cathode voltage) Vc which is generated at either end of the third resistor $R_{22}$ is proportional to the focus voltage Vf. Specifically, it is seen that the voltage (voltage Vc at either end of the third resistor $R_{22}$) at the node b between the second resistor $R_{21}$ and the third resistor $R_{22}$ becomes as follows:

$$Vc=Vf\times R_{21}/(R_{21}+R_{22}) \quad (3)$$

and is proportional to the focus voltage Vf. And, the focus voltage Vf is proportional to the tube voltage Vt, so that the cathode voltage Vc and the tube voltage Vt are in a proportional relationship.

Therefore, in the X-ray generator of the second embodiment, the cathode voltage Vc which is generated at either end of the third resistor $R_{22}$ is set to a level at which the tube current does not flow when a voltage having the same level as that is impressed between the cathode electrode 15 and the grid electrode 17, namely to the tube current breaking bias voltage Q shown in FIG. 3, and the tube current breaking cathode voltage Vc and the generated voltage Vb' of the bias voltage generating section 20 are combined to impress on the cathode electrode 15. In this case, the tube current breaking cathode voltage Vc changes, for example, along the straight line of the tube current breaking bias voltage Q (FIG. 3).

Besides, it is apparent from the relationship shown in FIG. 3 that the tube current can be flown by controlling the generated voltage Vb' of the bias voltage generating section 20 to only a direction to lower the tube current breaking cathode voltage Vc. Specifically, the tube current breaking cathode voltage Vc as the positive voltage and the generated voltage Vb' as the negative voltage of the bias voltage generating section 20 are combined, and a difference between them is impressed as the bias voltage Vb(=Vc−Vb') on the cathode electrode 15 to control the tube current.

Therefore, the generated voltage Vb' of the bias voltage generating section 20 required to control the tube current can be determined to fall in a range of, for example, 0 to 30V. The tube current can be controlled sufficiently by the generated voltage Vb' in such a narrow range. Therefore, it becomes possible to simplify the structure and control of the bias voltage generating section 20. Besides, even if the bias voltage generating section 20 fails, the tube current breaking cathode voltage Vc is impressed on the cathode electrode 15 from the voltage dividing section 31, so that a problem of melting the anode target 14 by the flow of an excessively large tube current can be prevented.

Figure 4:
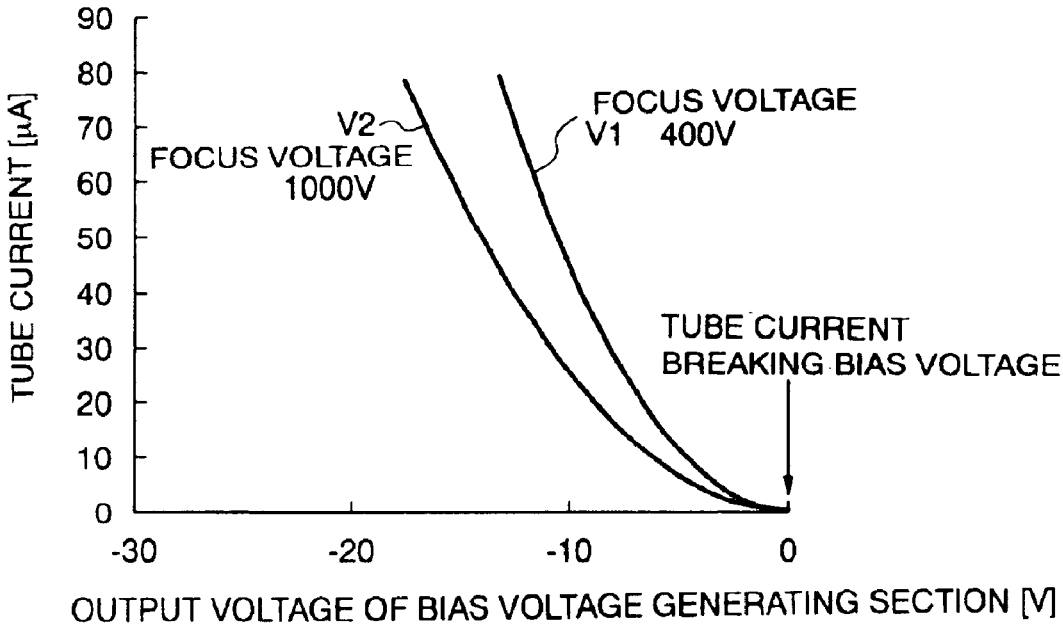
FIG. 4 is a characteristic diagram showing a relationship between an output voltage and a tube current of a bias voltage generating section of the X-ray generator according to the second embodiment of the invention.

Here, the relationship between the tube current and the generated voltage Vb' of the bias voltage generating section 20 with the focus voltage Vf changed will be described with reference to FIG. 4. In FIG. 4, the vertical axis indicates the tube current [$\mu$A], the horizontal axis indicates the generated voltage Vb' [V] of the bias voltage generating section 20, code V1 indicates that the focus voltage Vf is 400V, and code V2 indicates that the focus voltage is 1000V. Thus, even if the generated voltage Vb' of the bias voltage generating section 20 is in a narrow range of, for example, 0 to 30V, the tube current can be controlled to a required range.

According to the X-ray generator of the second embodiment described above, the tube voltage Vt is divided by the voltage dividing section 31 to generate the focus voltage Vf, so that an effect of a variation in voltage on the formation of a focal point of the electron beam can be reduced. And, a difference between tube current breaking cathode voltage Vc generated by the voltage dividing section 31 and the generated voltage Vb' of the bias voltage generating section 20 is impressed as the bias voltage Vb on the cathode electrode 15. Thus, the structure and control of the bias voltage generating section 20 can be simplified.

In addition, even if the bias voltage generating section 20 fails, the tube current breaking cathode voltage Vc is impressed from the voltage dividing section 31 on the cathode electrode 15, so that property deterioration or destruction of the X-ray tube 10 by an excessively large tube current can be prevented. In other words, the reliability and safety of the X-ray generator can be improved substantially. The grid electrode 17 described in this embodiment was set to the ground potential G, but the same operation can be made if the anode target 14 is set to a ground potential.

Figure 5:
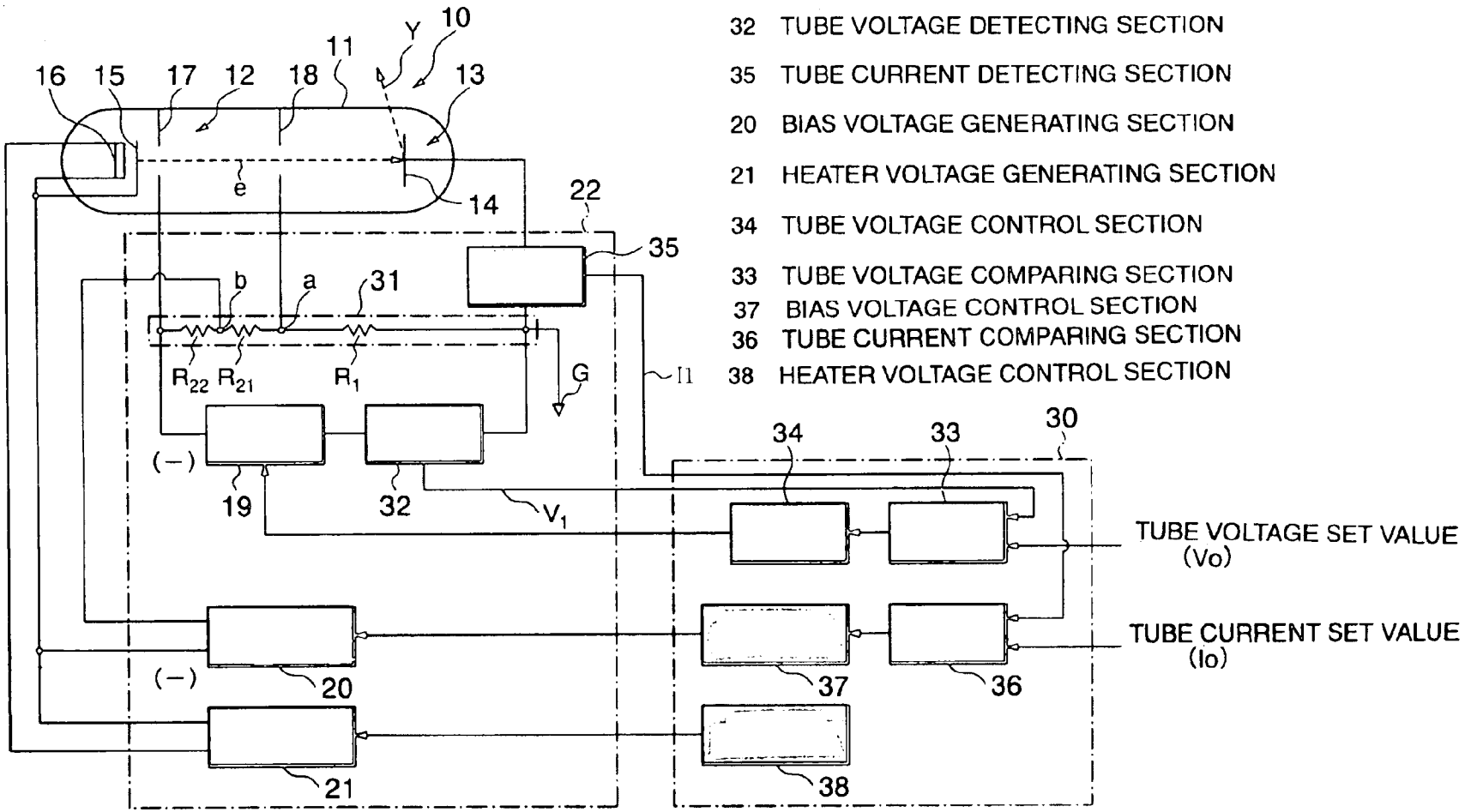
FIG. 5 is a diagram showing a schematic structure and circuitry of the X-ray generator according to a third embodiment of the invention.

Then, the X-ray generator according to a third embodiment of the invention will be described with reference to FIG. 5. FIG. 5 is a diagram showing a structure of the X-ray generator according to the third embodiment of the invention. Like reference numerals are used to denote components of FIG. 5 similar to those of FIGS. 1 and 2, and the repetition of description is partly omitted.

The X-ray generator of the third embodiment has the anode target 14, namely the anode 12, grounded G. And, a high voltage generating section 22 for generating a power supply voltage to be supplied to the micro focus X-ray tube 10 and a control section 30 for controlling the high voltage generating section 22 are disposed, and the high voltage generating section 22 is housed in, for example, an insulating material. The voltage dividing section 31 operates in the same way as in the above-described second embodiment.

In the third embodiment, the negative voltage generated by the tube voltage generating section 19 is impressed on the grid electrode 17. And, an output, voltage of the tube voltage generating section 19 is detected by a tube voltage detecting section 32. The tube voltage value V1 detected by the tube voltage detecting section 32 and the determined tube voltage set value V0 are compared by a tube voltage comparing section 33. This comparison data is sent to a tube voltage control section 34, and the tube voltage generating section 19 is controlled by the tube voltage control section 34 so that the tube voltage value V1 and the tube voltage set value V0 become equal.

And, a tube current I1 flowing between the cathode electrode 15 and the anode target 14 is detected by a tube current detecting section 35. The tube current value I1 detected by the tube current detecting section 35 and the determined tube current set value I0 are compared by a tube current comparing section 36. This comparison data is sent to the bias voltage control section 37, and the bias voltage generating section 20 is controlled by the bias voltage control section 37 so that the tube current value I1 and the tube current set value I0 become equal. The heater voltage generating section 21 is controlled by a heater voltage control section 38.

In the X-ray generator having the above-described structure, heating by the heater 16 causes to emit electrons e from the cathode electrode 15 to flow the tube current. The electron beam e emitted from the cathode electrode 15 has the tube current controlled by the grid electrode 17 and focused by the focus electrode 18 to collide against the anode target 14, and X rays are emitted in a direction of arrow Y from the anode target 14.

According to the X-ray generator of the third embodiment described above, an optimum focus voltage can be impressed on the focus electrode 18 even if a voltage of the anode target 14 is changed by pulsation or the like. Thus, a micro focal point of the electron beam can be reproduced accurately on the anode target 14. In the same way as in the above-described second embodiment, the bias voltage control range can be reduced, and it becomes possible to stably control a high-resolution tube current by a simple control circuit.

Figure 6:
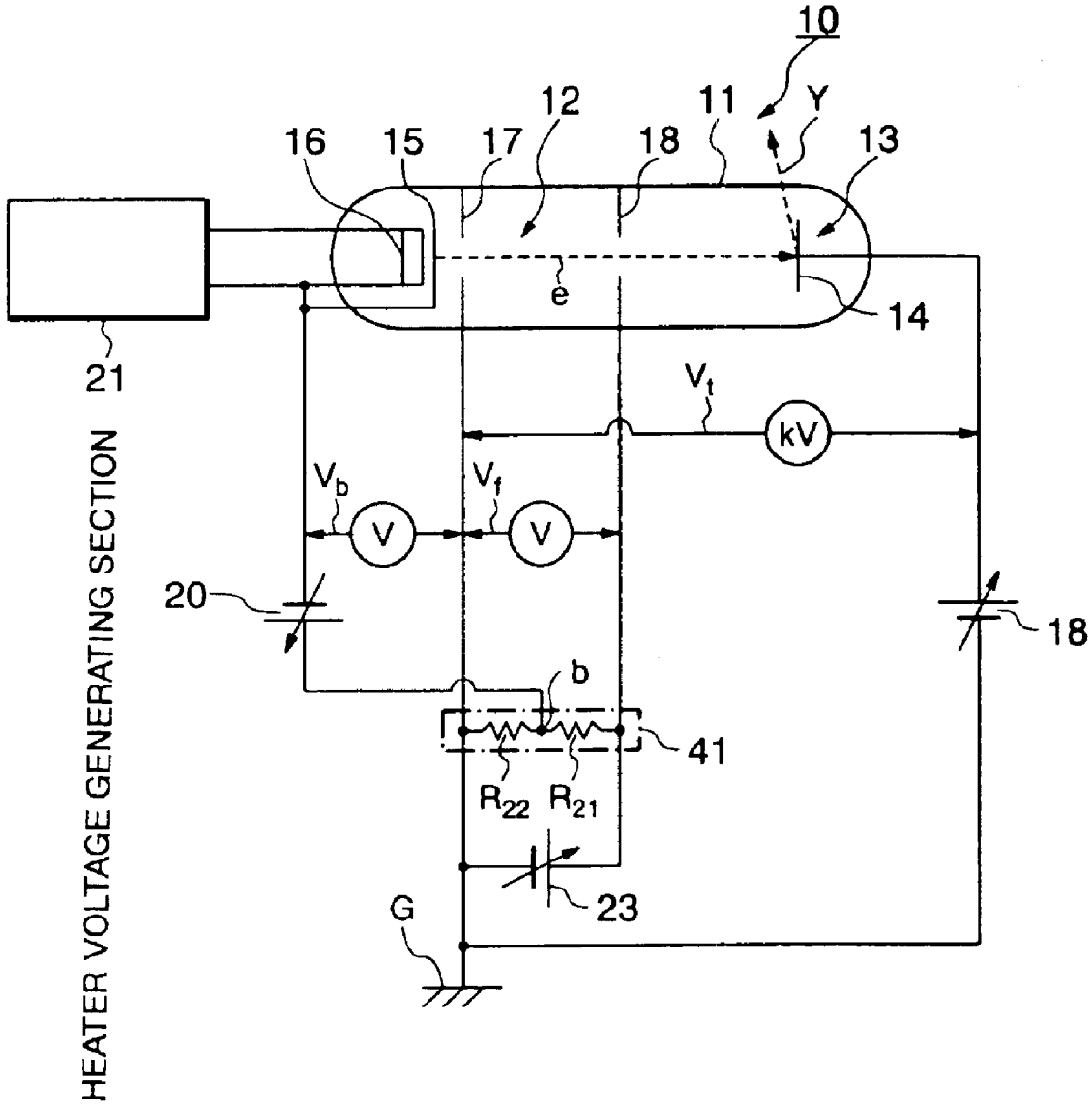
FIG. 6 is a diagram showing a schematic structure and circuitry of the X-ray generator according to a fourth embodiment of the invention.

Then, the X-ray generator according to a fourth embodiment of the invention will be described with reference to FIG. 6. FIG. 6 is a diagram showing a structure of the X-ray generator according to the fourth embodiment of the invention. Like reference numerals are used to denote components of FIG. 6 similar to those of FIGS. 1 and 2, and the repetition of description is partly omitted.

The X-ray generator according to the fourth embodiment has the grid electrode 17 set to the ground potential G. The output-variable tube voltage generating section 19 is connected between the anode target 14 and the ground potential G, and the tube voltage Vt which is positive to the grid electrode 17 is impressed on the anode target 14. An output-variable focus voltage generating section 23 is connected between the focus electrode 18 and the ground potential G, and the focus voltage Vf which is positive to the grid electrode 17 is impressed on the focus electrode 18. The bias voltage generating section 20 is connected between the cathode electrode 15 and the ground potential G to impress a negative voltage (output voltage Vb' (not shown)) to the cathode electrode 15.

A voltage dividing section 41 is connected in parallel to either end of the focus voltage generating section 23. This voltage dividing section 41 is comprised of two resistors $R_{21}$, $R_{22}$. These two resistors $R_{21}$, $R_{22}$ are connected in series. For example, a first resistor $R_{21}$ and a second resistor $R_{22}$ are arranged in decreasing order of potential of the focus voltage Vf23. And, the node b between the first resistor $R_{21}$ and the second resistor $R_{22}$ of the voltage dividing section 41 is connected to the cathode electrode 15 via the bias voltage generating section 20.

Specifically, the voltage dividing section 41 divides the focus voltage Vf according to the first resistor $R_{21}$ and the second resistor $R_{22}$ to generate the cathode voltage Vc (not shown) at either end of the second resistor $R_{22}$ so that the cathode electrode 15 has a voltage positive to the grid electrode 17. The cathode voltage Vc which is generated at either end of the second resistor $R_{22}$ is combined with the output voltage Vb' of the bias voltage generating section 20. The node b between the first resistor $R_{21}$ and the second resistor $R_{22}$ is connected to the positive terminal of the bias voltage generating section 20, so that a difference between the voltage (cathode voltage) Vc at either end of the second resistor $R_{22}$ and the output voltage Vb' of the bias voltage generating section 20 is supplied to the cathode electrode 15.

In the X-ray generator of the fourth embodiment, the cathode voltage Vc which is generated at either end of the second resistor $R_{22}$ is set to a level at which the tube current does not flow when a voltage of the same magnitude is impressed between the cathode electrode 15 and the grid electrode 17 in the same way as in the above-described second embodiment. A difference (Vc−Vb') between the tube current breaking cathode voltage (positive voltage) Vc and the generated voltage (negative voltage) Vb' of the bias voltage generating section 20 is impressed as the bias voltage Vb on the cathode electrode 15 to control the tube current by this bias voltage Vb(=Vc−Vb').

Thus, according to the X-ray generator of the fourth embodiment, the adjustment range of the bias voltage generating section 20 required to control the tube current can be narrowed in the same way as in the second embodiment.

Thus, the structure and control of the bias voltage generating section 20 can be simplified. Besides, even if the bias voltage generating section 20 fails, the tube current breaking cathode voltage Vc is impressed on the cathode electrode 15 from the voltage dividing section 31, so that it becomes possible to prevent the property deterioration or destruction of the X-ray tube 10 caused by an excessively large tube current. In other words, the reliability and safety of the X-ray generator can be improved remarkably.

In this embodiment, the description was made on setting of the grid electrode 17 to the ground potential G, but the same operation can be made when, for example, the anode target 14 is set to the ground potential.

Industrial Applicability

According to the X-ray generator of the present invention, an effect of a variation in voltage of the electron beam on the formation of a focal point can be suppressed. Therefore, the micro focal point of the electron beam can be reproduced accurately on the anode target. Besides, the reliability and safety of the X-ray generator can be improved. This X-ray generator of the present invention is effectively used for medical and industrial diagnostic devices and the like.

What is claimed is:

1. An X-ray generator, comprising:

a cathode electrode for generating an electron beam;

a grid electrode for controlling the passage of the electron beam generated by the cathode electrode;

a focus electrode for focusing the electron beam;

an anode target for emitting X rays by collision of the electron beam focused by the focus electrode;

a bias voltage generating section for generating a bias voltage to be impressed between the cathode electrode and the grid electrode;

a tube voltage generating section for generating a tube voltage to be impressed on the anode target; and a voltage dividing section for dividing the tube voltage to generate a focus voltage and impressing the focus voltage on the focus electrode, and dividing the focus voltage to generate a cathode voltage, wherein the cathode voltage generated by the voltage dividing section and the bias voltage generated by the bias voltage generating section are combined, and the combined voltage is impressed on the cathode electrode.

2. The X-ray generator according to claim 1, wherein the cathode voltage generated by the voltage dividing section is set to a magnitude not to flow a tube current when a voltage having the same magnitude as the cathode voltage is impressed between the cathode electrode and the grid electrode.

3. The X-ray generator according to claim 1, wherein the voltage dividing section is connected in parallel to the tube voltage generating section.

4. The X-ray generator according to claim 1, wherein the voltage dividing section is comprised of a first resistor, a second resistor and third resistor which are connected in series in decreasing order of potential of the tube voltage generating section, a node between the first resistor and the second resistor is connected to the focus electrode, and a node between the second resistor and the third resistor is connected to the bias voltage generating section.

5. An X-ray generator, comprising:

an X-ray tube having a cathode electrode for generating an electron beam, a grid electrode for controlling a flow or the electron beam generated by the cathode electrode, a focus electrode for focusing the electron beam, and an anode target for emitting X rays by collision of the electron beam focused by the focus electrode;

a bias voltage generating section for generating a bias voltage to be impressed between the cathode electrode and the grid electrode;

a bias voltage control section for controlling the bias voltage generated by the bias voltage generating section by detecting a tube current flowing to the X-ray tube and comparing the detected tube current with a reference value;

a tube voltage generating section for generating a tube voltage to be impressed on the anode target;

a tube voltage control section for controlling the tube voltage by detecting the tube voltage generated by the tube voltage generating section and comparing the detected tube voltage with a reference value; and a voltage dividing section for dividing the tube voltage to generate focus voltage and impressing the focus voltage on the focus electrode, and dividing the focus voltage to generate a cathode voltage, wherein the cathode voltage generated by the voltage dividing section and the bias voltage generated by the bias voltage generating section are combined, and the combined voltage is impressed on the cathode electrode.

6. The X-ray generator according to claim 5, wherein the cathode voltage generated by the voltage dividing section is set to a magnitude not to flow the tube current when a voltage having the same magnitude as the cathode voltage is impressed between the cathode electrode and the grid electrode.

7. An X-ray generator, comprising:

a cathode electrode for generating an electron beam;

a grid electrode for controlling a flow of the electron beam generated by the cathode electrode;

a focus electrode for focusing the electron beam;

an anode target for emitting X rays by collision of the electron beam focused by the focus electrode;

a tube voltage generating section for generating as tube voltage to be impressed on the anode target;

a focus voltage generating section for generating a focus voltage to be impressed on the focus electrode;

a bias voltage generating section for generating a bias voltage to be impressed between the cathode electrode and the grid electrode; and a voltage dividing section for dividing the focus voltage to generate cathode voltage and combining the cathode voltage with the bias voltage generated by the bias voltage generating section to impress on the cathode electrode.

8. The X-ray generator according to claim 7, wherein the cathode voltage generated by the voltage dividing section is set to a magnitude not to flow a tube current when a voltage having the same magnitude as the cathode voltage is impressed between the cathode electrode and the grid electrode.

* * * * *